US009946284B1

(12) United States Patent
Sundstrom

(10) Patent No.: US 9,946,284 B1
(45) Date of Patent: Apr. 17, 2018

(54) SINGLE EVENT EFFECTS IMMUNE LINEAR VOLTAGE REGULATOR

(71) Applicant: HONEYWELL INTERNATIONAL INC., Morris Plains, NJ (US)

(72) Inventor: Lance LeRoy Sundstrom, Pinellas Park, FL (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 0 days.

(21) Appl. No.: 15/398,415

(22) Filed: Jan. 4, 2017

(51) Int. Cl.
*G05F 1/595* (2006.01)
*G05F 1/46* (2006.01)
*G05F 1/575* (2006.01)

(52) U.S. Cl.
CPC ..... *G05F 1/595* (2013.01); *G05F 1/468* (2013.01); *G05F 1/575* (2013.01)

(58) Field of Classification Search
CPC ..... G05F 1/461; G05F 1/468; G05F 1/575; G05F 1/59; G05F 1/595; H02M 3/156; H02M 3/158; H02M 2003/156
See application file for complete search history.

(56) References Cited

U.S. PATENT DOCUMENTS 5,418,473 A 5/1995 Canaris
5,945,819 A 8/1999 Ursino et al.
6,333,623 B1 12/2001 Heisley et al.
6,809,504 B2 10/2004 Tang et al.
6,967,470 B2 11/2005 Takabayashi
7,071,664 B1 * 7/2006 Teggatz ..... H02J 7/0063 323/273
7,683,592 B2 3/2010 Soude et al.
7,821,240 B2 10/2010 Oddoart et al.
7,961,501 B1 6/2011 Ryan
8,040,118 B2 * 10/2011 Cho ..... G05F 1/565 323/273
8,242,847 B1 8/2012 Leong et al.
8,289,009 B1 * 10/2012 Strik ..... G05F 1/575 323/272
8,305,056 B2 11/2012 Wadhwa
8,334,681 B2 12/2012 Arigliano
8,436,677 B2 5/2013 Kull et al.
8,860,389 B2 10/2014 Gakhar et al.
2012/0146712 A1 6/2012 Kull et al.
(Continued)

FOREIGN PATENT DOCUMENTS

EP 1527457 5/2005

*Primary Examiner* — Matthew Nguyen
(74) *Attorney, Agent, or Firm* — Lorenz & Kopf, LLP

(57) ABSTRACT

A single event effects (SEE) immune linear voltage regulator includes an input node, an output node, a first transistor control logic, a second transistor control logic, a first transistor, and a second transistor. The regulator is configured such that when the first transistor is operating in linear regulation mode, the second transistor automatically operates in saturation mode, and the voltage at the output node is controlled by the first transistor and the first transistor control logic to be substantially equal to the first reference voltage. Conversely, when the second transistor is operating in linear regulation mode, the first transistor automatically operates in saturation mode, and the voltage at the output node is controlled by the second transistor and the second transistor control logic to be substantially equal to the second reference voltage.

20 Claims, 5 Drawing Sheets

(56) References Cited

U.S. PATENT DOCUMENTS

| | | | | |
|---|---|---|---|---|
| 2014/0002041 | A1* | 1/2014 | Soenen | G05F 1/575 323/281 |
| 2014/0111173 | A1* | 4/2014 | Lee | G05F 1/565 323/281 |
| 2016/0033984 | A1 | 2/2016 | Lee | |
| 2016/0224042 | A1 | 8/2016 | Pons | |
| 2016/0268885 | A1* | 9/2016 | Kumar | H02M 3/156 |
| 2016/0349777 | A1* | 12/2016 | Caracciolo | G05F 1/575 |

* cited by examiner

SINGLE EVENT EFFECTS IMMUNE LINEAR VOLTAGE REGULATOR

TECHNICAL FIELD

The present invention generally relates to voltage regulator circuits, and more particularly relates to a linear voltage regulator that is immune to single event effects (SEE).

BACKGROUND

Linear voltage regulators, such as pass transistor-based linear voltage regulators, can be designed to be radiation hardened (RH), and thereby have a relatively high total ionizing dose (TID) tolerance. The topology of these circuits, however, is inherently susceptible to other types of radiation, such as heavy ion, proton and neutron radiation, which can cause what are known as single event effects (SEE). Because a heavy ion, proton or neutron is relatively small compared to an integrated circuit (IC) element, its effect is typically limited to a single IC element, such as a transistor, which is why the effect is referred to an SEE.

For example, in pass transistor-based linear voltage regulators, a direct SEE upset of the pass transistor can generate hole and electron pairs within its junction that causes it to turn on harder or saturate. This can result in a positive transient output voltage. If an SEE upset of an IC element, such as an internal reference current source or op amp, were to occur, this could cause either a negative or positive transient output voltage depending on where it hits. A negative transient output voltage that is below the minimum operating supply voltage of one or more of the connected device(s) can interrupt their operation, but will not typically cause permanent damage. However, a positive transient output voltage that is above the absolute maximum operating supply voltage of one or more of the connected device(s) can cause permanent damage.

In some instances, SEE events can be alleviated by adding a series resistor at the voltage regulator input or output. However, this remedy usually requires a relatively high value resistance (compared to the pass transistor on-resistance), which can greatly increase the voltage regulator step load response time and/or cause instability.

Hence, there is a need for a linear voltage regulator design that is not inherently SEE susceptible and does not compromise voltage regulation, step load performance, or stability. The present invention addresses at least these needs.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

In one embodiment, a single event effects (SEE) immune linear voltage regulator includes an input node, an output node, a first transistor control logic, a second transistor control logic, a first transistor, and a second transistor. The first transistor control logic is adapted to receive a first reference voltage and is configured to supply a first transistor control voltage. The second transistor control logic is adapted to receive a second reference voltage and is configured to supply a second transistor control voltage. The first transistor is coupled to the output node and to the first transistor control voltage. The first transistor is configured, in response to the first transistor control voltage, to selectively operate in one of a linear regulation mode and a saturation mode. The second transistor is coupled to the input node, to the first transistor, and to the second transistor control voltage. The second transistor is configured, in response to the second transistor control voltage, to selectively operate in a linear regulation mode and a saturation mode. When the first transistor is operating in linear regulation mode, the second transistor automatically operates in saturation mode, and the voltage at the output node is controlled by the first transistor and the first transistor control logic to be substantially equal to the first reference voltage. When the second transistor is operating in linear regulation mode, the first transistor automatically operates in saturation mode, and the voltage at the output node is controlled by the second transistor and the second transistor control logic to be substantially equal to the second reference voltage.

In another embodiment, a single event effects (SEE) immune linear voltage regulator includes an input node, an output node, a first reference voltage source, a second reference voltage source, a first transistor control logic, a second transistor control logic, a first transistor, and a second transistor. The first reference voltage source is configured to supply a first reference voltage, and the second reference voltage source is configured to supply a second reference voltage. The first transistor control logic is coupled to receive the first reference voltage from the first reference voltage source, and is configured to supply a first transistor control voltage. The second transistor control logic is coupled to receive the second reference voltage from the second reference voltage source, and is configured to supply a second transistor control voltage. The first transistor is coupled to the output node and is coupled to receive the first transistor control voltage. The first transistor is configured, in response to the first transistor control voltage, to selectively operate in one of a linear regulation mode and a saturation mode. The second transistor is coupled to the input node, to the first transistor, and to the second transistor control voltage. The second transistor is configured, in response to the second transistor control voltage, to selectively operate in one of a linear regulation mode and a saturation mode. When the first transistor is operating in linear regulation mode, the second transistor automatically operates in saturation mode, and the voltage at the output node is controlled by the first transistor and the first transistor control logic to be substantially equal to the first reference voltage. When the second transistor is operating in linear regulation mode, the first transistor automatically operates in saturation mode, and the voltage at the output node is controlled by the second transistor and the second transistor control logic to be substantially equal to the second reference voltage.

In yet another embodiment, a single event effects (SEE) immune linear voltage regulator includes an input node, an output node, a first operational amplifier, a second operational amplifier, a first transistor, and a second transistor. The first operational amplifier is coupled to receive a first reference voltage and is configured to supply a first transistor control voltage. The second operational amplifier is coupled to receive a second reference voltage and is configured to supply a second transistor control voltage. The first transistor is coupled to the output node and to receive the first transistor control voltage. The first transistor is configured, in response to the first transistor control voltage, to selectively operate in one of a linear regulation mode and a saturation mode. The second transistor is coupled to the input node, to the first transistor, and to the second transistor control voltage. The second transistor is configured, in response to the second transistor control voltage, to selectively operate in one of a linear regulation mode and a saturation mode. The first operational amplifier comprises an inverting input, a non-inverting input, and an output, and the non-inverting input of the first operational amplifier is adapted to receive the first reference voltage. The second operational amplifier comprises an inverting input, a non-inverting input, and an output, and the inverting input of the second operational amplifier is adapted to receive the second reference voltage. The output node is coupled to the inverting input of the first operational amplifier, and to the non-inverting input of the second operational amplifier. When the first transistor is operating in linear regulation mode, the second transistor automatically operates in saturation mode, and the voltage at the output node is controlled by the first transistor and the first transistor control logic to be substantially equal to the first reference voltage. When the second transistor is operating in linear regulation mode, the first transistor automatically operates in linear regulation mode, and the voltage at the output node is controlled by the second transistor and the second transistor control logic to be substantially equal to the second reference voltage.

Furthermore, other desirable features and characteristics of the single event effects (SEE) immune linear voltage regulator will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1:
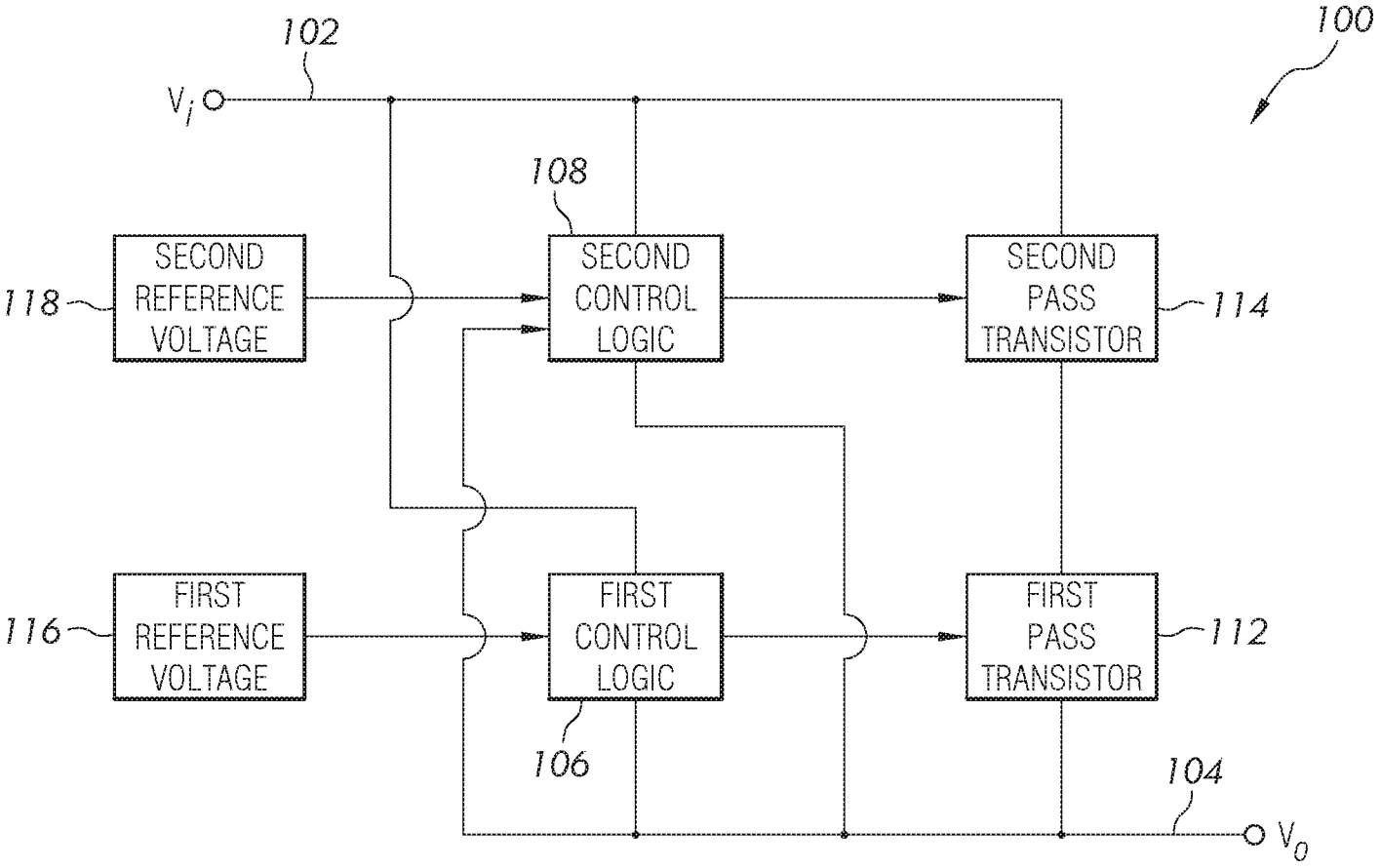
FIG. 1 depicts a functional block diagram of one embodiment of a single event effects (SEE) immune linear voltage regulator.

Referring now to FIG. 1, a functional block diagram of one embodiment of a single event effects (SEE) immune linear voltage regulator 100 is depicted. The depicted regulator 100 includes a Vi input node 102, a Vo output node 104, a first transistor control logic 106, a second transistor control logic 108, a first transistor 112, and a second transistor 114. The first transistor control logic 106 is configured to receive a first reference voltage from, for example, a first reference voltage source 116, and is configured to supply a first transistor control voltage. The second transistor control logic 108 is configured to receive a second reference voltage from, for example, a second reference voltage source 118, and is configured to supply a second transistor control voltage.

The first transistor 112 is coupled to the Vo output node 104, to the second transistor 114 and to the first transistor control voltage from the first transistor control logic 106. The first transistor 112 is configured, in response to the first transistor control voltage, to selectively operate in one of a linear regulation mode and a saturation mode. The second transistor 114 is coupled to the Vi input node 102, to the first transistor 112 and to the second transistor control voltage from the second transistor control logic 108. The second transistor 114 is configured, in response to the second transistor control voltage, to selectively operate in a linear regulation mode and a saturation mode.

The configuration of the regulator 100 is such that when the first transistor 112 is operating in linear regulation mode, the second transistor 114 automatically operates in saturation mode. As a result, the voltage at the Vo output node 104 is controlled by the first transistor 112 and the first transistor control logic 106 to be substantially equal to the first reference voltage 116. Conversely, when the second transistor 114 is operating in linear regulation mode, the first transistor 112 automatically operates in saturation mode. As a result, the voltage at the Vo output node 104 is controlled by the second transistor 114 and the second transistor control logic 108 to be substantially equal to the second reference voltage.

Figure 2:
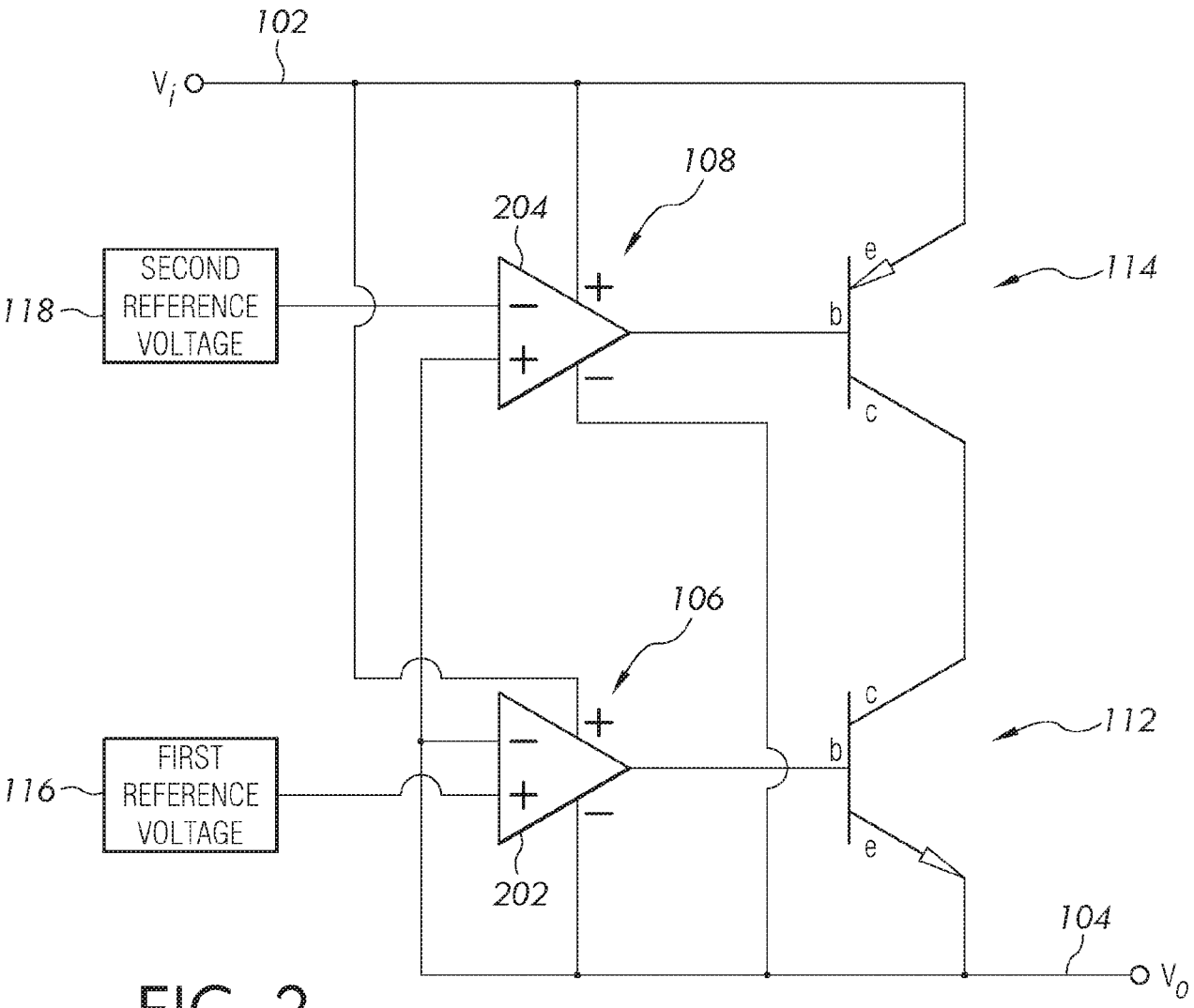
FIGS. 2 and 3 depict schematic circuit diagrams of specific embodiments of the SEE immune linear voltage regulator of FIG. 1.

It will be appreciated that the first transistor control logic 106, the second transistor control logic 108, the first transistor 112, and the second transistor 114 may be variously implemented to achieve the functionality described above. In one embodiment, which is depicted in FIG. 2, the first transistor control logic 106 and the second transistor control logic 108 are both implemented using operational amplifiers. Specifically, the first transistor control logic 106 comprises a first operational amplifier 202, and the second transistor control logic 108 comprises a second operational amplifier 204. As is generally known, the first and second operational amplifiers each comprise an inverting input, a non-inverting input, and an output. As FIG. 2 further depicts, the non-inverting input of the first operational amplifier 202 is coupled to the first reference voltage 116, and the inverting input of the first operational amplifier is coupled to the Vo output node 104. In addition, the inverting input of the second operational amplifier is coupled to the second reference voltage 118, and the non-inverting input of the second operational amplifier is coupled to the Vo output node 104.

As FIG. 2 also depicts, the first and second transistors 112, 114 are implemented using bi-polar transistors. In particular, the first transistor 112 comprises an NPN bi-polar transistor, and the second transistor 114 comprises a PNP bi-polar transistor. As is generally known, bi-polar transistors each include a base terminal (b), an emitter terminal (e), and a collector terminal (c). The base terminal (b) of the first transistor 112 is coupled to the first transistor control voltage from the output of the first operational amplifier 202, and the base terminal (b) of the second transistor 114 is coupled to the second transistor control voltage from the output of the second operational amplifier 204. The collector terminal (c) of the first transistor 112 is coupled to the collector terminal (c) of the second transistor 114. The emitter terminal (e) of the first transistor 112 is coupled to the Vo output node 104, and the emitter terminal (e) of the second transistor 114 is coupled to the Vi input node 102. With appropriate control logic, the pass transistors 112 and 114 could also be two NPN or two PNP transistors.

Figure 3:
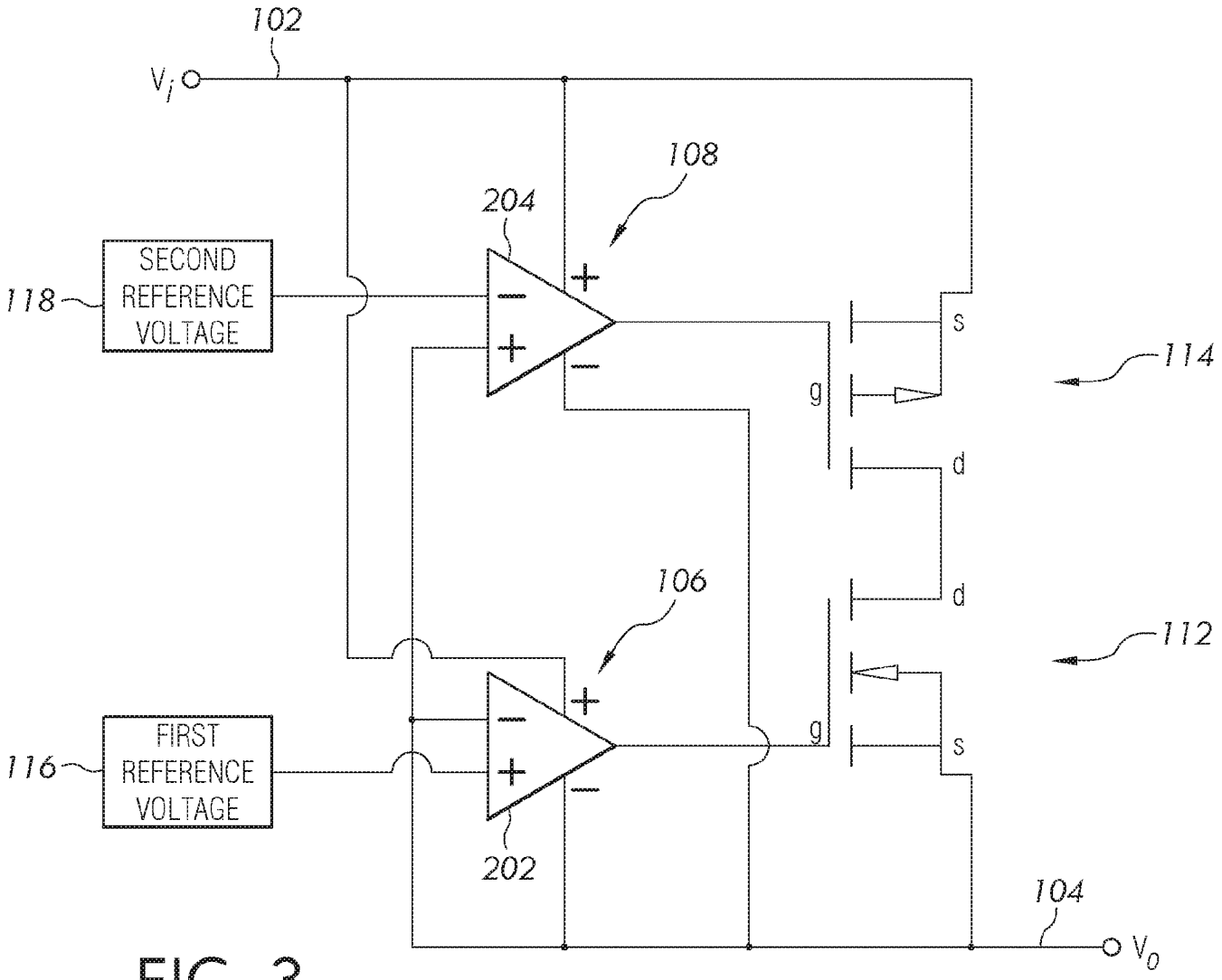

In another embodiment, which is depicted in FIG. 3, while the first and second transistor control logics 106 and 108, respectively, are again implemented using operational amplifiers, the first and second transistors 112 and 114, respectively, are implemented as metal-oxide semiconductor (MOS) transistors. Specifically, the first transistor 112 comprises an N-channel metal oxide semiconductor (NMOS) transistor, and the second transistor 114 comprises a P-channel metal oxide semiconductor (PMOS) transistor. As is generally known, MOS transistors each include a gate terminal (g), a source terminal (s), and a drain terminal (d). The gate terminal (g) of the first transistor 112 is coupled to the first transistor control voltage from the output of the first operational amplifier 202, and the gate terminal (g) of the second transistor 114 is coupled to the second transistor control voltage from the output of the second operational amplifier 204. The drain terminal (d) of the first transistor 112 is coupled to the drain terminal (d) of the second transistor 114. The source terminal (s) of the first transistor 112 is coupled to the Vo output node 104, and the source terminal (s) of the second transistor 114 is coupled to the Vi input node 102. With appropriate control logic, the pass transistors 112 and 114 could also be two NMOS or two PMOS transistors.

Figure 4:
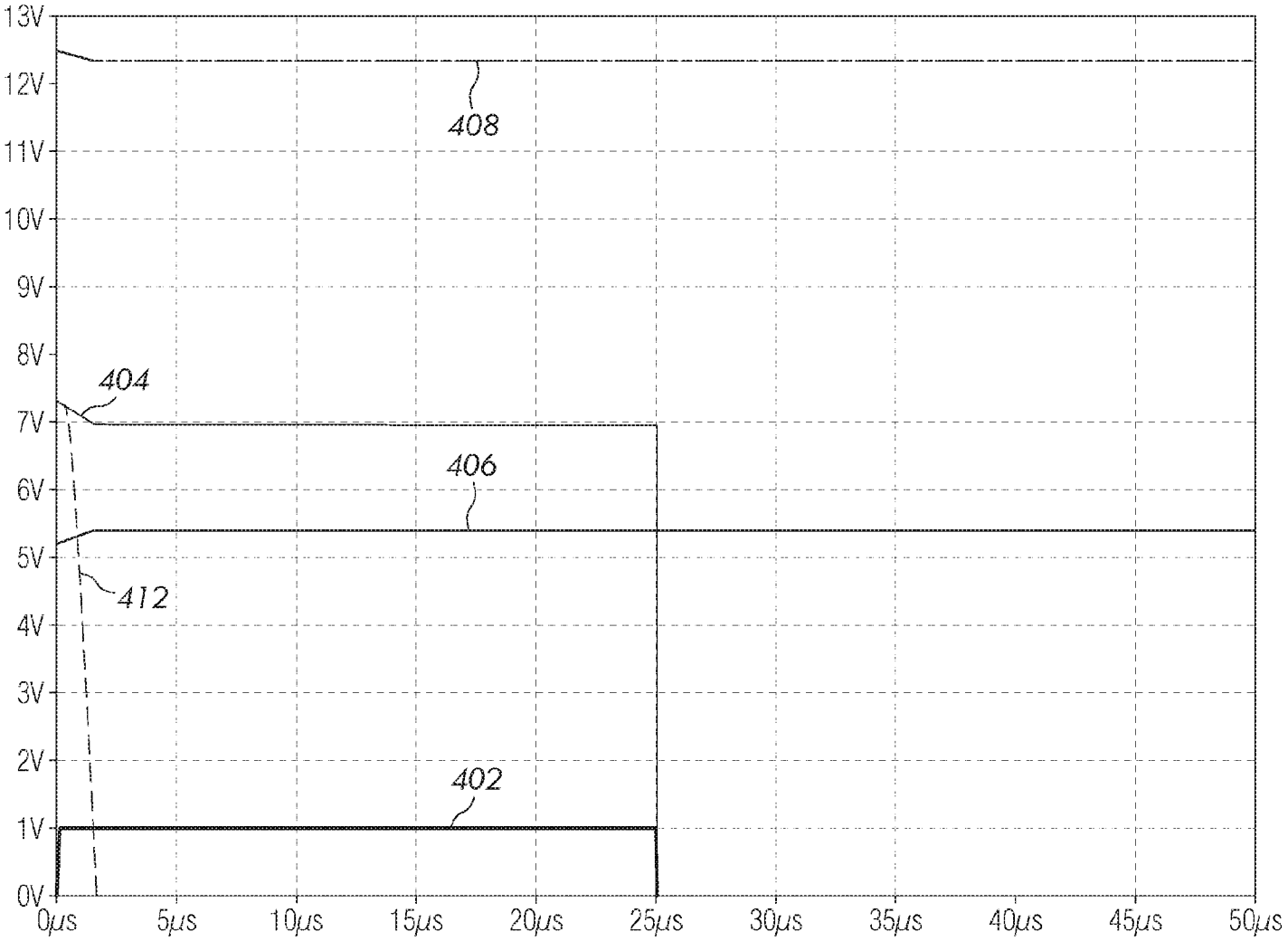
FIG. 4 depicts simulation results of the SEE immune linear voltage regulators of FIGS. 2 and 3 under worst case conditions for a 25 μsec SEE induced positive transient output voltage.

Simulation results for the regulator circuits depicted in FIGS. 1-3 indicate that the regulator 100 disclosed herein is indeed SEE immune. In particular, simulation results for the regulator 100, under worst case conditions for a 25 μsec SEE induced positive transient output voltage, are depicted in FIG. 4. It should be noted that worst case conditions are defined as maximum Vi input voltage, maximum input capacitance, maximum initial regulated Vo output voltage, minimum output load, and minimum output capacitance. It is further noted that the depicted simulation results are for a regulator 100 that has its Vi input node 102 connected to a 12.5 VDC source (e.g., Vin=12.5 VDC), and that is configured to supply 5.2 VDC at the Vo output node 104 (e.g., Vout=5.2 VDC). For this simulation, the first reference voltage source 116 is configured to supply 5.20 VDC, the second reference voltage source 118 is configured to supply 5.21 VDC and as a result, the first transistor 112 with the lower reference voltage is initially operating in linear regulation mode, and the second transistor 114 with the higher reference voltage is operating in saturation mode.

As FIG. 4 depicts, when the SEE transient 402 occurs, the first transistor control voltage 404 goes high, which causes the first transistor 112 to transition from linear regulation mode to saturation mode. Thus, momentarily, the first and second transistors 112, 114 are both in saturation mode, which causes the output voltage 406 at the Vo output node 104 to begin to increase toward the input voltage 408 at the Vi input node 102. This, in turn, causes the second transistor control voltage 412 to go low, which transitions the second transistor 114 into the linear regulation mode. This transfer of regulation from the first transistor 112 to the second transistor 114 occurs in approximately 2 μsec, which is significantly less than the worst case 25 μsec SEE duration. As a result, the Vi input voltage 408 drops to only 12.36 VDC, and the Vo output voltage 406 rises to only 5.38 VDC, which is well within the 4.5-5.5 VDC operating range of most 5 VDC devices.

Figure 5:
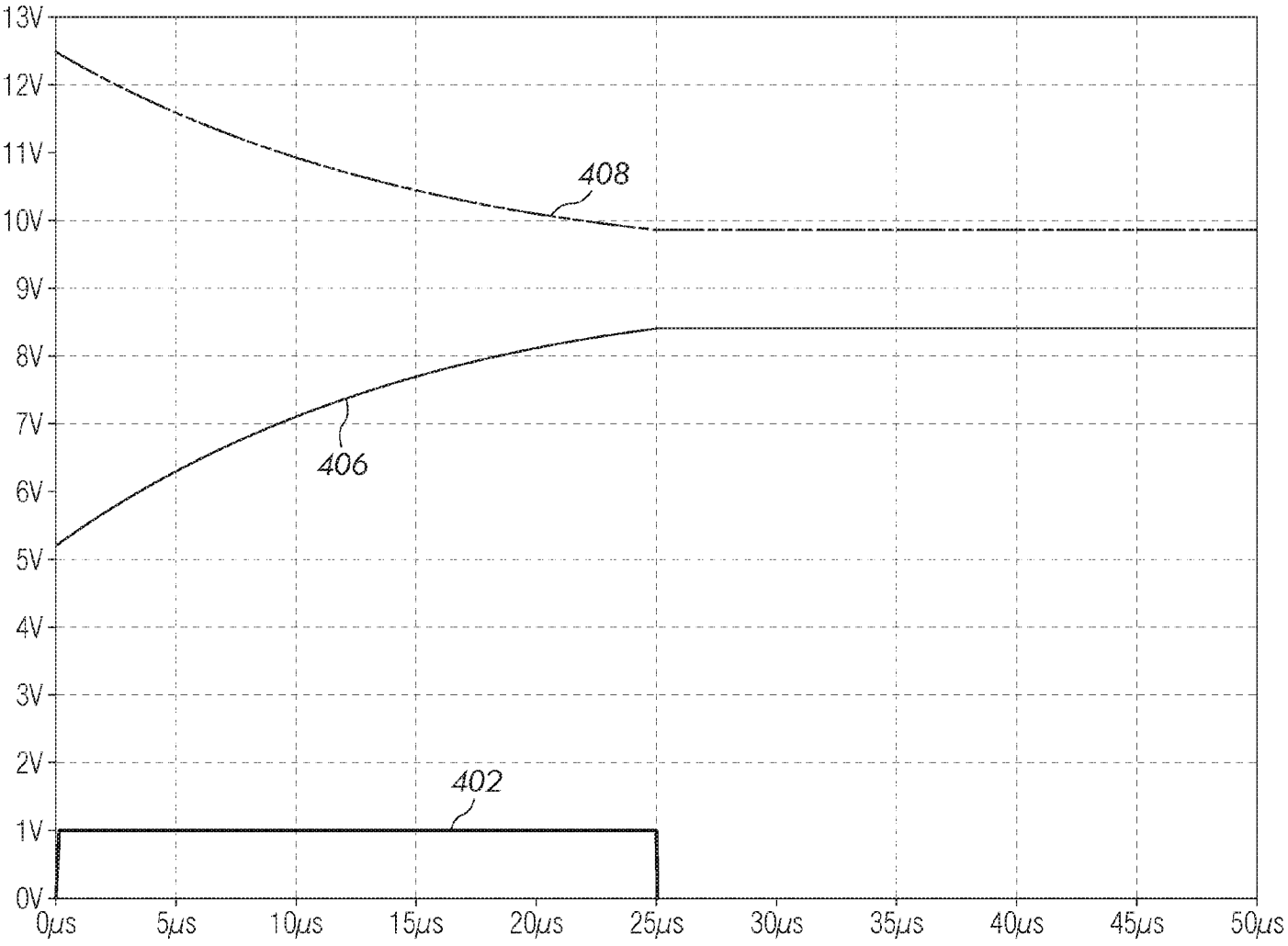
FIG. 5 depicts simulation results for a conventional linear voltage regulator under worst case conditions for a 25 μsec SEE induced positive transient output voltage.

For comparison, simulation results for a conventional regulator circuit, under worst case conditions for a 25 μsec SEE induced positive transient output voltage, are depicted in FIG. 5. As this simulation shows, the Vi input voltage 408 drops from 12.5 VDC to 9.87 VDC, while the Vo output voltage 406 rises from 5.2 VDC to 8.42 VDC. This voltage is well above both the 4.5-5.5 VDC operating range and the −0.5V to +7.0V absolute maximum range of most 5 VDC devices. Moreover, any connected device(s) could suffer an interrupt of operation and/or permanent damage.

The linear voltage regulator disclosed herein is not inherently SEE susceptible and does not compromise voltage regulation, step load performance, or stability.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A single event effects (SEE) immune linear voltage regulator, comprising:

an input node and an output node;

a first transistor control logic adapted to receive a first reference voltage and configured to supply a first transistor control voltage;

a second transistor control logic adapted to receive a second reference voltage and configured to supply a second transistor control voltage;

a first transistor coupled to the output node and to the first transistor control voltage, the first transistor configured, in response to the first transistor control voltage, to selectively operate in one of a linear regulation mode and a saturation mode; and a second transistor coupled to the input node, to the first transistor, and to the second transistor control voltage, the second transistor configured, in response to the second transistor control voltage, to selectively operate in a linear regulation mode and a saturation mode, wherein:

when the first transistor is operating in linear regulation mode, the second transistor automatically operates in saturation mode, and the voltage at the output node is controlled by the first transistor and the first transistor control logic to be substantially equal to the first reference voltage; and when the second transistor is operating in linear regulation mode, the first transistor automatically operates in saturation mode, and the voltage at the output node is controlled by the second transistor and the second transistor control logic to be substantially equal to the second reference voltage.

2. The linear voltage regulator of claim 1, wherein:

the first transistor comprises a NPN bi-polar transistor;

the second transistor comprises a PNP bi-polar transistor; and the first and second transistors each include a base terminal, an emitter terminal, and a collector terminal.

3. The linear voltage regulator of claim 2, wherein:

the base terminal of the first transistor is coupled to receive the first transistor control voltage;

the base terminal of the second transistor is coupled to receive the second transistor control voltage;

the collector terminal of the first transistor is coupled to the collector terminal of the second transistor;

the emitter terminal of the first transistor is coupled to the output node; and the emitter terminal of the second transistor is coupled to the input node.

4. The linear voltage regulator of claim 1, wherein:

the first transistor comprises an N-channel metal oxide semiconductor (NMOS) transistor;

the second transistor comprises an P-channel metal oxide semiconductor (PMOS) transistor; and the first and second transistors each include a gate terminal, a source terminal, and a drain terminal.

5. The linear voltage regulator of claim 4, wherein:

the gate terminal of the first transistor is coupled to receive the first transistor control voltage;

the gate terminal of the second transistor is coupled to receive the second transistor control voltage;

the drain terminal of the first transistor is coupled to the drain terminal of the second transistor;

the source terminal of the first transistor is coupled to the output node; and the source terminal of the second transistor is coupled to the input node.

6. The linear voltage regulator of claim 1, wherein:

the first transistor control logic comprises a first operational amplifier; and the second transistor control logic comprises a second operational amplifier.

7. The linear voltage regulator of claim 6, wherein:

the first operational amplifier comprises an inverting input, a non-inverting input, and an output;

the non-inverting input of the first operational amplifier is adapted to receive the first reference voltage;

the second operational amplifier comprises an inverting input, a non-inverting input, and an output; and the inverting input of the second operational amplifier is adapted to receive the second reference voltage.

8. The linear voltage regulator of claim 7, wherein the output node is coupled to the inverting input of the first operational amplifier, and to the non-inverting input of the second operational amplifier.

9. A single event effects (SEE) immune linear voltage regulator, comprising:

an input node and an output node;

a first reference voltage source configured to supply a first reference voltage;

a second reference voltage source configured to supply a second reference voltage;

a first transistor control logic coupled to receive the first reference voltage from the first reference voltage source, the first transistor control logic configured to supply a first transistor control voltage;

a second transistor control logic coupled to receive the second reference voltage from the second reference voltage source, the second transistor control logic configured to supply a second transistor control voltage;

a first transistor coupled to the output node and coupled to receive the first transistor control voltage, the first transistor configured, in response to the first transistor control voltage, to selectively operate in one of a linear regulation mode and a saturation mode; and a second transistor coupled to the input node, to the first transistor, and to the second transistor control voltage, the second transistor configured, in response to the second transistor control voltage, to selectively operate in one of a linear regulation mode and a saturation mode, wherein:

when the first transistor is operating in linear regulation mode, the second transistor automatically operates in saturation mode, and the voltage at the output node is controlled by the first transistor and the first transistor control logic to be substantially equal to the first reference voltage; and when the second transistor is operating in linear regulation mode, the first transistor automatically operates in saturation mode, and the voltage at the output node is controlled by the second transistor and the second transistor control logic to be substantially equal to the second reference voltage.

10. The linear voltage regulator of claim 9, wherein:

the first transistor comprises a NPN bi-polar transistor;

the second transistor comprises a PNP bi-polar transistor; and the first and second transistors each include a base terminal, an emitter terminal, and a collector terminal.

11. The linear voltage regulator of claim 10, wherein:

the base terminal of the first transistor is coupled to receive the first transistor control voltage;

the base terminal of the second transistor is coupled to receive the second transistor control voltage;

the collector terminal of the first transistor is coupled to the collector terminal of the second transistor;

the emitter terminal of the first transistor is coupled to the output node; and the emitter terminal of the second transistor is coupled to the input node.

12. The linear voltage regulator of claim 9, wherein:

the first transistor comprises an N-channel metal oxide semiconductor (NMOS) transistor;

the second transistor comprises an P-channel metal oxide semiconductor (PMOS) transistor; and the first and second transistors each include a gate terminal, a source terminal, and a drain terminal.

13. The linear voltage regulator of claim 12, wherein:

the gate terminal of the first transistor is coupled to receive the first transistor control voltage;

the gate terminal of the second transistor is coupled to receive the second transistor control voltage;

the drain terminal of the first transistor is coupled to the drain terminal of the second transistor;

the source terminal of the first transistor is coupled to the output node; and the source terminal of the second transistor is coupled to the input node.

14. The linear voltage regulator of claim 9, wherein:

the first transistor control logic comprises a first operational amplifier; and the second transistor control logic comprises a second operational amplifier.

15. The linear voltage regulator of claim 14, wherein:

the first operational amplifier comprises an inverting input, a non-inverting input, and an output;

the non-inverting input of the first operational amplifier is adapted to receive the first reference voltage;

the second operational amplifier comprises an inverting input, a non-inverting input, and an output; and the inverting input of the second operational amplifier is adapted to receive the second reference voltage.

16. The linear voltage regulator of claim 15, wherein the output node is coupled to the inverting input of the first operational amplifier, and to the non-inverting input of the second operational amplifier.

17. A single event effects (SEE) immune linear voltage regulator, comprising:

an input node and an output node;

a first operational amplifier coupled to receive a first reference voltage and configured to supply a first transistor control voltage;

a second operational amplifier coupled to receive a second reference voltage and configured to supply a second transistor control voltage;

a first transistor coupled to the output node and coupled to receive the first transistor control voltage, the first transistor configured, in response to the first transistor control voltage, to selectively operate in one of a linear regulation mode and a saturation mode; and a second transistor coupled to the input node, to the first transistor, and to the second transistor control voltage, the second transistor configured, in response to the second transistor control voltage, to selectively operate in one of a linear regulation mode and a saturation mode, wherein:

the first operational amplifier comprises an inverting input, a non-inverting input, and an output;

the non-inverting input of the first operational amplifier is adapted to receive the first reference voltage;

the second operational amplifier comprises an inverting input, a non-inverting input, and an output;

the inverting input of the second operational amplifier is adapted to receive the second reference voltage;

the output node is coupled to the inverting input of the first operational amplifier, and to the non-inverting input of the second operational amplifier;

when the first transistor is operating in linear regulation mode, the second transistor automatically operates in saturation mode, and the voltage at the output node is controlled by the first transistor and the first transistor control logic to be substantially equal to the first reference voltage; and when the second transistor is operating in linear regulation mode, the first transistor automatically operates in linear regulation mode, and the voltage at the output node is controlled by the second transistor and the second transistor control logic to be substantially equal to the second reference voltage.

18. The linear voltage regulator of claim 17, wherein:

the first transistor comprises a NPN bi-polar transistor;

the second transistor comprises a PNP bi-polar transistor; and the first and second transistors each include a base terminal, an emitter terminal, and a collector terminal;

the base terminal of the first transistor is coupled to receive the first transistor control voltage;

the base terminal of the second transistor is coupled to receive the second transistor control voltage;

the collector terminal of the first transistor is coupled to the collector terminal of the second transistor;

the emitter terminal of the first transistor is coupled to the output node; and the emitter terminal of the second transistor is coupled to the input node.

19. The linear voltage regulator of claim 17, wherein:

the first transistor comprises an N-channel metal oxide semiconductor (NMOS) transistor;

the second transistor comprises an P-channel metal oxide semiconductor (PMOS) transistor; and the first and second transistors each include a gate terminal, a source terminal, and a drain terminal;

the gate terminal of the first transistor is coupled to receive the first transistor control voltage;

the gate terminal of the second transistor is coupled to receive the second transistor control voltage;

the drain terminal of the first transistor is coupled to the drain terminal of the second transistor;

the source terminal of the first transistor is coupled to the output node; and the source terminal of the second transistor is coupled to the input node.

20. The linear voltage regulator of claim 17, further comprising:

a first reference voltage source coupled to the first operational amplifier and configured to supply the first reference voltage; and a second reference voltage source coupled to the second operational amplifier and configured to supply the second reference voltage.

* * * * *